US006602172B1

(12) United States Patent
Aigner

(10) Patent No.: US 6,602,172 B1
(45) Date of Patent: Aug. 5, 2003

(54) SPORT APPARATUS

(75) Inventor: Ewald Aigner, Vienna (AT)

(73) Assignee: MFT-Multi Funktionale Trainingsgeräte GmbH, Guntramsdorf (AT)

( * ) Notice: Subject to any disclaimer, the term of this patent is extended or adjusted under 35 U.S.C. 154(b) by 0 days.

(21) Appl. No.: 09/622,471

(22) PCT Filed: Feb. 15, 1999

(86) PCT No.: PCT/AT99/00039

§ 371 (c)(1),
(2), (4) Date: Aug. 29, 2000

(87) PCT Pub. No.: WO99/42183

PCT Pub. Date: Aug. 26, 1999

(30) Foreign Application Priority Data

Feb. 17, 1998 (AT) ..... 280/98

(51) Int. Cl.[7] ..... A63B 22/14
(52) U.S. Cl. ..... 482/147; 482/79; 482/80
(58) Field of Search ..... 482/79–80, 147

(56) References Cited

U.S. PATENT DOCUMENTS

| | | | | |
|---|---|---|---|---|
| 4,183,521 A | * | 1/1980 | Kroeker | |
| 4,193,592 A | * | 3/1980 | Bishow | 272/114 |
| 4,199,137 A | | 4/1980 | Giguere | |
| 5,399,140 A | * | 3/1995 | Klippel | 482/146 |

FOREIGN PATENT DOCUMENTS

| | | |
|---|---|---|
| EP | 0338 295 A2 | 10/1989 |
| GB | 1 509 306 A | 5/1978 |

* cited by examiner

*Primary Examiner*—Nicholas D. Lucchesi
*Assistant Examiner*—Lori Baker Amerson
(74) *Attorney, Agent, or Firm*—Henry M. Feiereisen; Ursula B. Day

(57) ABSTRACT

The present invention relates to a sport apparatus intended for training, wherein said apparatus comprises a base plate (1) preferably in the shape of a disc as well as rocking skids (4) provided on one side of the base plate. A standing plate (100) is mounted so as to be capable of rotation to the base plate (1) so that a rotation movement can be superimposed to the rocking movement thanks to said standing plate (100).

12 Claims, 3 Drawing Sheets

SPORT APPARATUS

The invention relates to a sport apparatus for training purposes comprising preferably a disk-shaped base plate with rocking skids attached to one side of the base plate.

Apparatuses of this type which are known in the prior art facilitate the toning and firming of the musculature as well as balance training.

However, with the conventionally known apparatuses only relatively simple movements may be carried out, resulting essentially always in uneven stress to the body. Additionally, certain particularly important aspects of the body training are being neglected. Thus, even in professional athletes as well as in untrained persons a certain hardening of the muscles, shortening of the muscles or similar can occur, which are the result of prolonged repetitive body movements. For example, skiers often suffer from this phenomenon in that they may have good control over their movements when making a turn in one direction, whereas they tend to make mistakes when making a turn in the other direction. Such fast kinetic processes can only be improved by mental training because conscious influencing of the process is not possible. However, conventional sports apparatuses are not suitable for these purposes.

Among the most frequently observed limitations of the body's motion mechanism are in particular, shortening of the musculature in the region of the spine, which, because of pressure exerted on it, also often causes damage to the vertebrae and the intervertebral disks. Furthermore, repetitive stress such as extended periods of sitting, may cause great diminishment of pelvic mobility resulting in severe postural damage.

It is therefore an object of the present invention to provide a sports apparatus of the type as discussed in the introductory paragraph, with which the body's kinetic skill and kinetic mobility can be raised.

A further object of the invention is to provide a sports apparatus with which an improved kinetic awareness and kinetic sensation as well as neuromuscular sensitization can be realized.

In accordance with the invention, this is accomplished by providing a standing platform which is rotatable relative to the base plate, such that when standing on the standing platform a rotational motion overlapping with a rocking motion may be carried out.

With the sports apparatus according to the invention, the leg musculature as well as the pelvic musculature, vertical steadiness and the sense of balance can be trained. The combination of rocking motion and rotational motion makes it particularly possible to attain harmonization and activation of the kinetic processes which are coordinated by the psychological processes, such as coherent waves of the cerebral hemispheres or hemispheric synchronization.

In a further embodiment of the invention, a central bearing shell is disposed on the base plate at the side opposite the rocking skids, and is rotationally supported relative to the base plate along a rotational axis extending essential normal to the base plate, such that the bearing shell can be brought into operative connection with the standing platform.

The rotational motion of the standing platform relative the base plate is thus made possible whereby the standing platform is removable from the bearing shell in a simple way.

A further feature of the invention provides that the bearing shell is supported by ball bearings whereby a particularly frictionless rotational motion is realized.

In accordance with a further embodiment of the invention, the bearing shell is configured in the form of a hollow cylinder with an axis of symmetry forming the rotational axis such that the front face of the hollow cylinder pointing away from the base plate forms the contact surface for the operative connection with the standing platform.

This arrangement permits an easy exchange without the need for attachment of the standing platform, since the platform is held in operational contact with the bearing shell by its own weight and the weight of the person training thereon, so that by a suitable motion of the person on the platform rotation of the platform ensues.

In accordance with a further feature of the invention, the platform has a dynamically balanced configuration with a centering pin disposed at the center of the bottom side for operative engagement with the bearing shell; a preferably circular contact plate is provided which is penetrated by the central pin and which engages with the contact surface when the standing platform is placed on the bearing shell.

Displacement of the standing platform is made impossible by means of the central pin holding the rotating standing platform at its center of rotation in the center of the bearing shell.

In a further embodiment of the invention, casters are provided at the radial outer region on the bottom side of the standing platform and when supported by the bearing shell, they come in contact with the base plate from which they roll off when the standing platform rotates.

Thus, an additional support of the weight impacting on the standing platform is realized whereby the casters minimize the friction operating against the rotational movement.

In accordance with a further embodiment of the invention, the standing platform is formed by a center portion with the central pin, wherein the center portion extends into two side portions transversely to the center portion and which are configured approximately in the shape of an outline of a foot.

In this manner, the standing platform's own weight may be reduced to just the necessary level rendering the standing platform also sensitive to minimal weight shift of the body which requires a very high level of skill in order to control the rotational motion.

In accordance with a further embodiment of the invention, a particularly advantageous distribution of the casters is attained by disposing one caster each at opposite end regions of each side portion.

Border rails may be provided at the outer edge of the side portions of the standing platform in order to avoid sliding off the standing platform during the body movements.

The standing platform can be adapted to any desired shape including a rectangular shape.

In accordance with the invention, the sports apparatus for training purposes preferably has a disk-shaped base plate.

Furthermore, it is an object of the invention to provide a sports apparatus of the afore-discribed type with which the level of skill and freedom of body motions can be raised.

A further object of the invention is to provide a sports apparatus with which an improvement in kinetic awareness and kinetic sense as well as neuro-muscular sensitability can be realized.

In accordance with the invention, this is realized by providing on one side of the base plate a central spherical and elastic rolling element which, relative the base plate, is rotatably supported along a rotational axis extending in the direction essentially normal to the base plate.

The elastic rolling element which is rotatably supported facilitates the combination of a rolling and rotational motion which, like the rocking and rotational motion, has a specifically positive effect on the harmonization and activation of the psychological processes controlling body movements, such as the wave coherence of both cerebral hemispheres, and which effects hemispheric synchronization and regulates concentration and attention span.

In a further embodiment of the invention, a central bearing shell is disposed at the base plate, and is rotatably supported relative to the base plate, such that the bearing shell is provided with a rotation-symmetrical opening at a rotational axis for receiving the spherical elastic rolling element.

In this manner, the bearing shell may be used as support for the standing platform as well as receive the rolling element, such that rocking-rotational motions and rolling-rotational motions can be carried out when the base plate with the rolling element at the bottom is placed on the base support, which permits rolling motions with the base plate when the side opposite the rolling element is used as the standing surface.

In accordance with a further embodiment of the invention, the spherical elastic rolling element can be press-fit into the opening of the bearing shell.

In a simple manner the elastic rolling element can thus be placed into and removed from the bearing shell.

In accordance with a further embodiment of the invention, a tennisball provides a particularly stable and elastic form of a rolling element.

In accordance with yet another embodiment of the invention, rocking skids are removably attached to the base plate. The rocking skids may be removed for those specific cases when they would interfere with the rolling-rotational motions which are carried out when a rolling element is used.

In accordance with yet a further embodiment of the invention, an additional central bearing shell is provided on the side where the rocking skids are disposed at the base plate, and is rotationally supported along a rotational axis extending in a direction essentially normal to the rotational axis of the base plate, such that the bearing shell can be brought in operational engagement, such that a rotational motion overlapping with a rocking motion can be carried out with the standing platform.

In this manner, a twofold rotational bearing exists along one axis.

The advantages and effects resulting therefrom which are realized by means of the specific configuration of the standing platform have already been described in connection with the rocking-rotational sports apparatus according to the invention.

Furthermore, the invention relates to a sports apparatus which is a combination of the rocking-rotational sports apparatus and the rolling-rotational sports apparatus.

In accordance with the invention, this combination is attained when the bearing shell is alternatively brought into operative engagement with the standing plate or the spherical elastic rolling element inserted into the bearing shell.

In this manner, rocking-rotational motions as well as rolling-rotational motions with the base plate are realized.

The invention is now described in detail in accordance with the embodiments as described in the following paragraphs, where:

Figure 7:
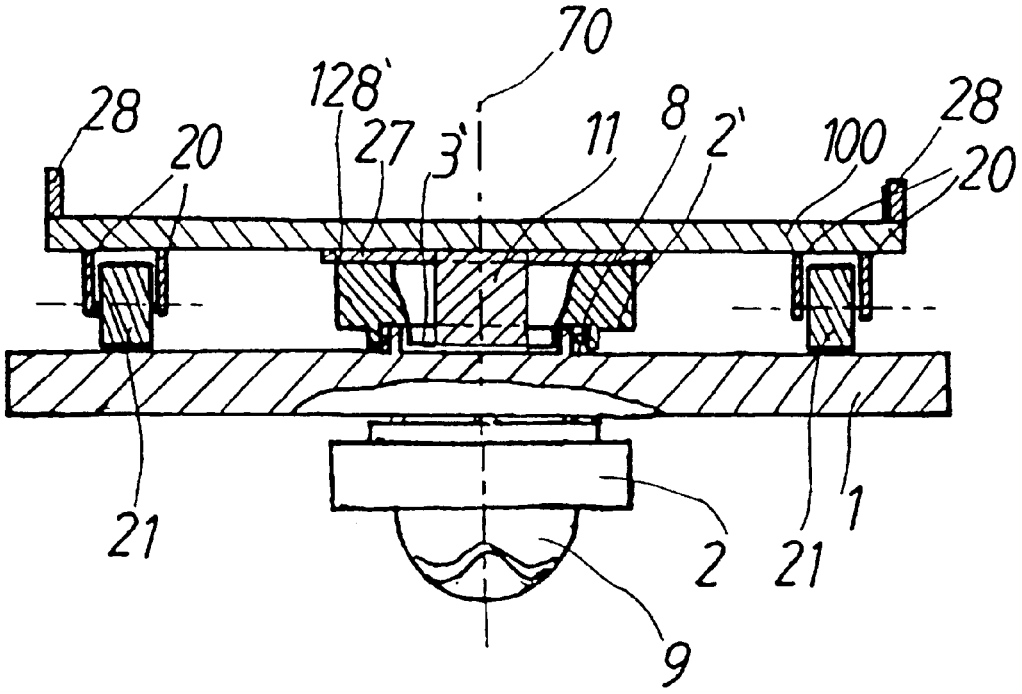

FIG. 7 a partial section of the sports apparatus in rolling-rotational position.

Figure 1:
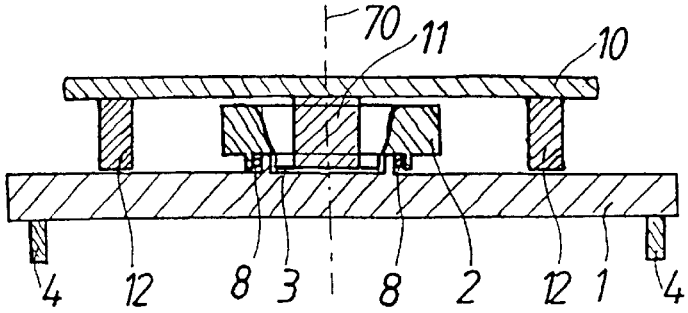
FIG. 1 is a cross section of an embodiment of the sports apparatus according to the invention in rocking position.

FIG. 1 shows a sports apparatus for training purposes having a disk shaped base plate 1 with rocking skids 4 disposed at one side which is supported by a plane surface during rocking, for example, by the floor. In the base position as shown, simple rocking motions are carried out in the same manner as with an apparatus of the type conventionally known. To provide an improved standing platform for the rocking position, the apparatus has a rectangular standing board 10 with support blocks 12 and a central pin 11, which engages with clearance into a ring 3 of bearing shell 2.

In accordance with the invention, a standing platform 100 (FIG. 5) is provided which is rotatably disposed relative to the base plate 1, such that the standing platform permits a rotational motion that overlaps with a rocking motion.

The side of the baseplate 1 opposite the rocking skids 4, is disposed with a central bearing shell 2, which is rotationally supported relative to the base plate 1 extending essentially normal to the base plate 1 and along a rotational axis 70.

In the rocking modus as shown in FIG. 1, the function of this bearing shell is eliminated with the use of the standing platform 10 when the described rocking motion is carried out.

Figure 5:
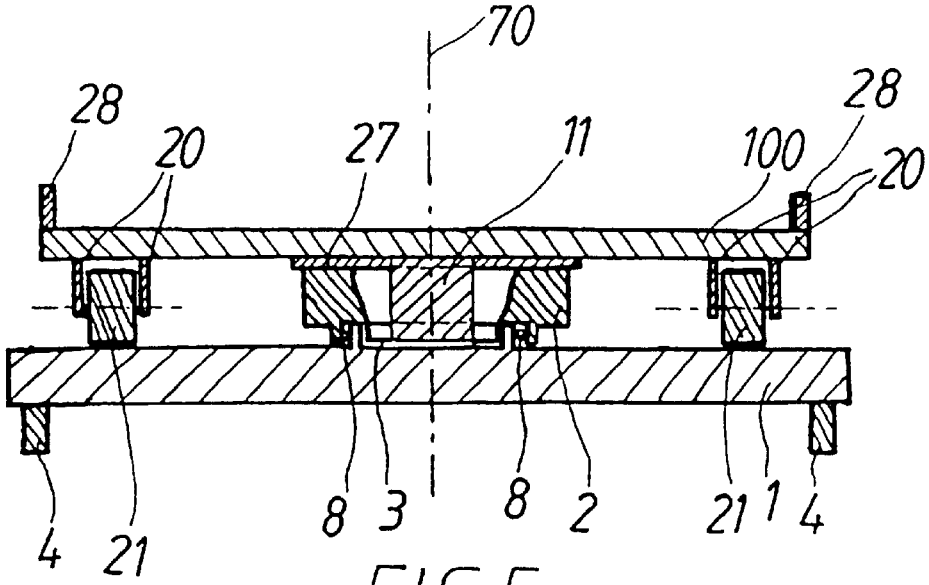
FIG. 5 is a cross section of the sports apparatus in rocking-rotational position.

Utilization of the sports apparatus according to the invention is shown in FIG. 5, wherein the bearing shell 2 is in operative engagement with the standing platform 100, thereby permitting the rotational motion as shown in FIG. 1 and also a rotational motion that overlaps with the rocking motion.

To this end, the standing platform 100 carries out the rotational motion facilitated by the bearing shell 2. Through its body movements, the trained person that can either stand, sit, kneel or crouch on the standing platform and can bring the rotational motions to overlap with the rocking motions in such a way that an effective relaxation of the musculature is realized. Particularly when in standing position, muscle spasms from the pelvic musculature can be released.

This proves to be highly effective especially for high performance athletes but also for those who normally do not pursue any sports activity. Uneven body posture which is the result of repetitive stress can thereby be counteracted.

The rotational motion is particularly friction-reduced since the bearing shell 2 is supported in a ball bearing 8.

FIG. 5 shows bearing shell 2 configured in the shape of a hollow cylinder where the rotation axis 70 is also its axis of symmetry. The contact surface which is engagable with the standing plate 100 is formed by the front face 128 of cylinder (FIG. 2) facing away from the base plate.

Figure 6:
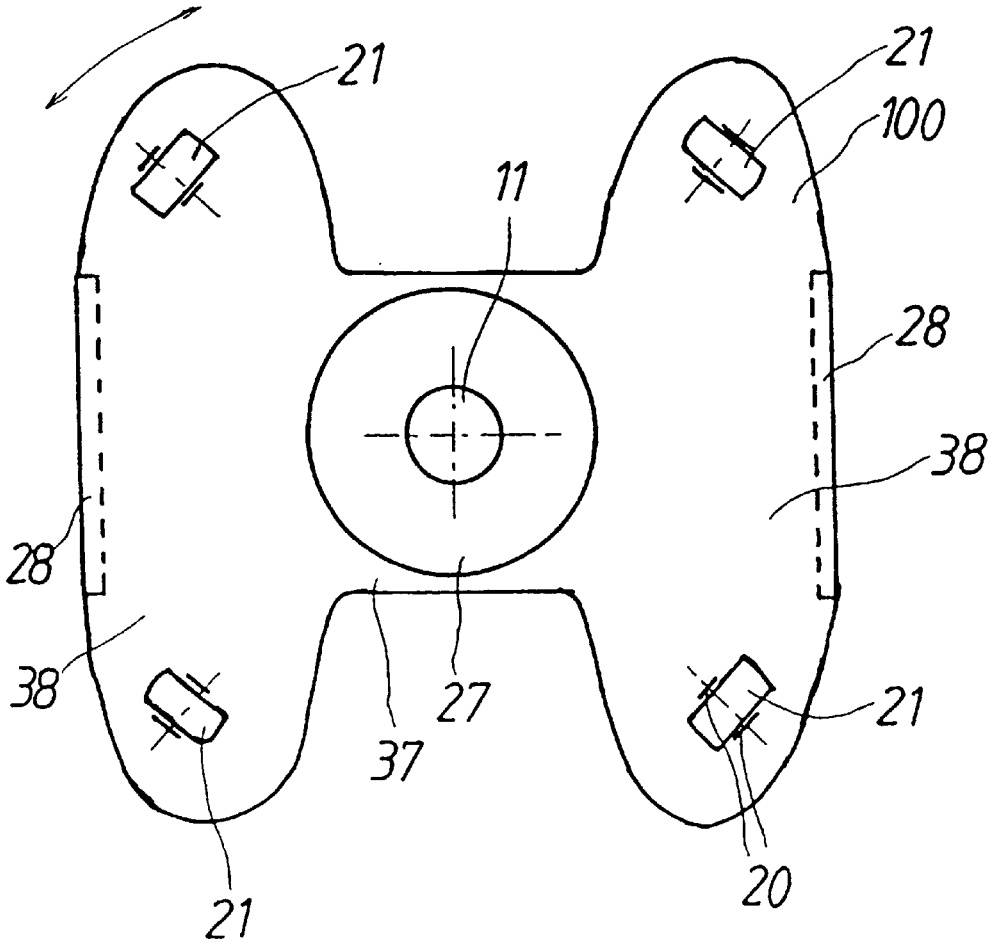
FIG. 6 is a bottom plan view of the sports apparatus of FIG. 5.

FIG. 6 shows a preferred embodiment of standing platform 100 which is rotation symmetrically configured with a bottom side having a central pin 11 at the center of symmetry for engagement with the bearing shell 2. The bottom side of base plate 1 is disposed with a circular shaped contact plate 27 which is penetrated by central pin 11 and which enters into operative engagement with its contact surface 128 when the standing platform is placed onto the bearing shell. When the user is standing on the standing platform 100 of the apparatus, the standing platform, in addition to being supported for rocking is also rotationally supported by means of the rocking skids 4.

The rotational motion of standing platform 100 is supported by casters 21 in the outer radial region, which are disposed at the bottom side of standing platform 100 and which engage in contact with the base plate 1 when standing platform 100 is placed atop bearing shell 2 and thus are rolling away from the base plate when it rotates. The casters are attached to standing platform 100 by means of shackles 20.

The standing platform 100 according to FIG. 6 is formed with a central part 37, a central pin 11 and side portions 38 which are extending from the central part in transverse direction thereto and which are preferably in the shape of about the outline of a foot. A caster 21 is disposed on each of the end regions of side portions 38. No limits are given for the shape of the standing platform 10, which may simply be in rectangular or circular shape.

Additionally, border rails 28 are disposed at the lateral edges of side portions 38 of standing platform 100 to prevent the user sliding off the standing platform during the rotational rocking motions.

Figure 2:
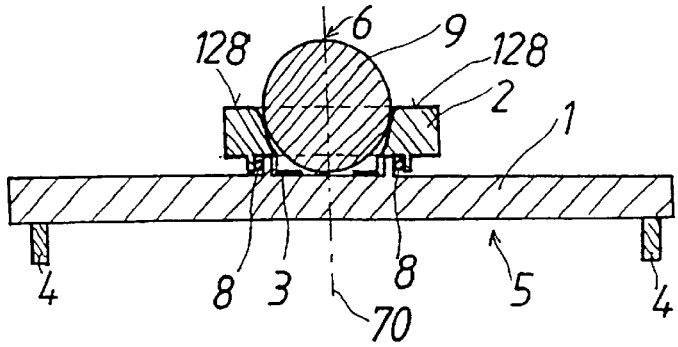
FIG. 2 is a cross section of the sport apparatus of FIG. 1 in the rolling position.
Figure 3:
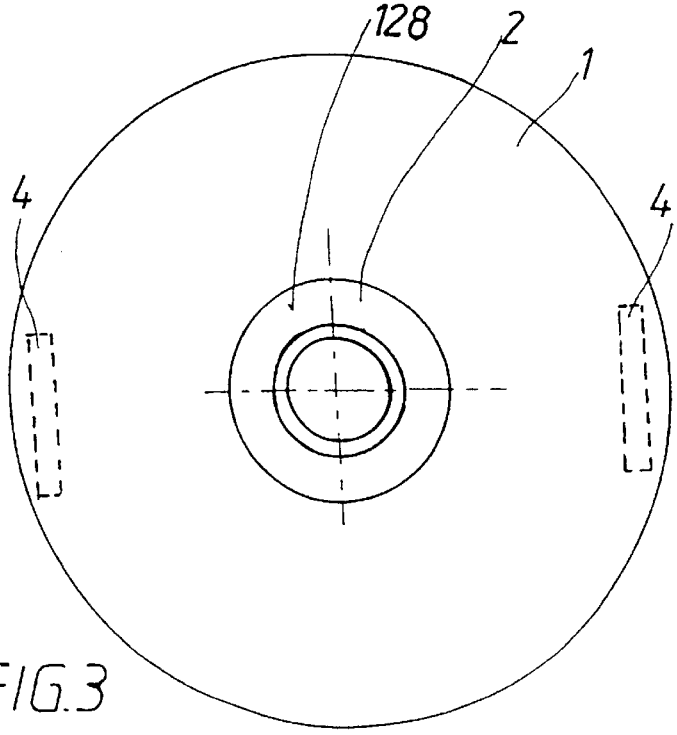
FIG. 3 is a plan view of the sports apparatus according to FIG. 2.

A further function of the sports apparatus is shown in FIG. 2 wherein a spherical elastic rolling element 9 is centrally disposed at one side of the base plate 1, and is rotationally supported relative to the base plate along a rotational axis 70 extending approximately normal to the base plate 1.

The central bearing shell 2 disposed at the base plate 1 has an opening rotation symmetrically shaped along a rotation axis, for receiving the spherical elastic rolling element 9. The opening is of a dimension such that the spherical elastic rolling element 9 is press-fit into the bearing shell 2 where it stays through press friction. Attachment mechanisms for the sliding element 9 other than shown in FIG. 2 may also be used, but the one shown has the advantage that the bearing shell is especially suited for that purpose and can also receive the central pin as shown in FIG. 5, thereby fulfilling a dual function.

Figure 4:
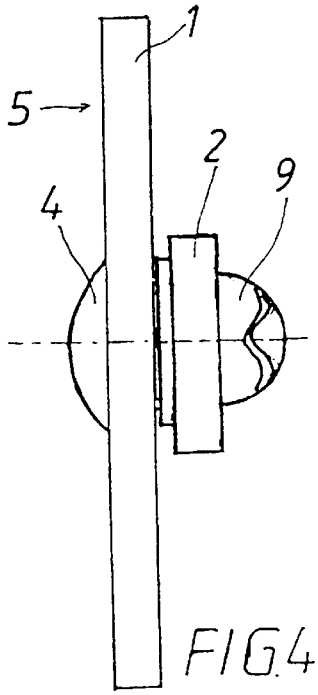
FIG. 4 is a side view of the sports apparatus according to FIG. 3.

Preferably, the spherical elastic rolling element is a tennisball 9 as shown in FIG. 4. When the side 5 of the base plate 1 is thus used as a standing platform, rolling motions can be performed with the sports apparatus according to the invention.

To avoid obstructions, the rocking skids may be removably attached to the base plate, for example they my be attached by a snap-fit.

When training to reach a steady position and a sense of balance, the user places the feet onto the standing platform 5 and tries balancing at the point of support point 6 of tennis ball 9, whereby as an additional degree of difficulty, due to the rotational capacity of the ball bearing supported bearing shell, rotations which are caused by weight shifting have to be counteracted. Maintaining one's balance can be practiced despite pelvic gyrations, thus simulating motions made when skiing or snowboarding.

Balancing may be trained in a similar manner when the user is sitting on the side 5 of the disk-shaped base element with parallel legs stretched out. By means of shifting the user's weight, balance can be maintained at the point of support 6 of the tennis ball 9.

In the embodiment as shown in FIG. 7, an additional central bearing shell 2' is provided at the side where the rocking skids are normally placed but have been removed, and which is, relative to the base plate, rotationally supported along a rotational axis 70 oriented essentially normal to the base plate.

The bearing shell 2' is in operative connection with the standing platform 100 such that a further rotational motion is realized in addition to the rotational motion that overlaps with the rolling movement. Mastering this combination of two rotational motions and a rolling motion requires special skill and represents the highest degree of difficulty.

Similar to the bearing shell 2, the bearing shell 2' is configured in the shape of a hollow cylinder whose axis of symmetry form the rotational axis 70, whereby the front face 28' which points away from the base plate 1 forms the respective contact surface.

The standing platform 100 corresponds to that as depicted in FIG. 5 and FIG. 6.

When the tennis ball 9 is removed from bearing shell 2, the skids 4 are reattached onto the standing platform 100 in order to carry out a rocking and rotation motion as shown with the sports apparatus in FIG. 5.

With the sport apparatus as illustrated in FIGS. 2, 5 and 7 in combination with the standing platform 100 and the elastic rolling element 9 divers training methods may be carried out, whereby overlapping rocking- and rotational motions as well as overlapping rolling- and rotational motions are realized with the same apparatus.

Due to the variety of these different motions a psychomotor/psycho-muscular training for preventive and therapeutic purposes can be devised, whereby a complex psycho-regulatory regimen is fulfilled that comprises elements of different mental exercises, such as for example, balancing, tilting and rotating exercises and swing dynamic exercises, muscular tensioning and relaxing exercises which are directed to harmonizing and activating psychological processes, such as for example, coherent waves of both cerebral hemispheres, hemispheric synchronization, regulation of awareness and attention span or similar, as well as optimizing physiological steps such as kinetic sense, neuromuscular sensitability or similar.

Depending on the choice of the exercises the sports apparatus according to the invention serves as a motion modulator and/or stabilizes the tension joints, the knee joints, the pelvic region as well as strengthens the entire postural mechanism in particular, the leg, pelvis and abdominal musculature. Through decompression of the spine, a correct posture is realized.

This provides the opportunity for structural and receptive study of the actual mental basis of movements. According to the principle of open and closed skills in sports (Knapp 1963/64) it is important to note, that incorporated into open motions may be closed motions, which are environment dependent and always repeated. The student has thus the opportunity to evaluate his/her own mistakes. The student should thereby acquire a reliable inner detection mechanism for errors that is based on the evaluation of his/her own intrinsic kinesthetic-, visual- and auditory feed back. This should foster the acquisition of freedom of motion to a considerable degree. The result is not only greater precision but also a greater stability of fundamental motion technique.

As result, there is a change in subjective experience. The changes of the external process of motion and the execution and control process based thereon go hand in hand with the subjective experience. Secondary automatism's are an effortless mental experience, where motions are carried out without conscious effort similar to the subjective experience of reflexes, the flow-experience.

What is claimed is:

1. A sports apparatus for training purposes comprising:

a base plate;

one or more rocking skids disposed at one side of the base plate for a carrying out a rocking motion;

a standing platform disposed at the base plate and rotatable relative to the base plate such that a rotational motion can be carried out with the standing platform which overlaps with the rocking motion carried out with the base plate, wherein the standing platform is provided with a central bearing shell which is rotatably supported relative to the base plate about a rotational axis essentially normal to the base plate and for operative engagement with the standing platform.

2. The sports apparatus of claim 1, wherein the bearing shell is supported by ball bearings.

3. The sports apparatus of claim 1, wherein the bearing shell is shaped as a hollow cylinder having a front face and a central rotational axis, said front face forms a contact surface for operative engagement with the standing platform.

4. The sport apparatus of claim 1, wherein the standing platform is shaped rotation symmetrical and wherein a pin is centrally disposed at a bottom side of the platform and operatively connected to the bearing shell.

5. The sport apparatus of claim 4, further comprising a plurality of casters disposed at the bottom side of the standing platform for providing a rolling contact with the base plate when the standing plate is supported by the bearing shell.

6. The sport apparatus of claim 1, wherein the standing platform has a central portion and two outer portions, each portion extending laterally from the central portion.

7. The sport apparatus of claim 6, wherein the laterally extending portions each have opposite end zones and are substantially in the shape of a foot.

8. The sport apparatus of claim 7, wherein each of the opposite end zones of the side portions are provided with a caster.

9. The sport apparatus of claim 7, wherein each of the side portions is provided at a lateral edge with a border rail.

10. The sport apparatus of claim 1, wherein the standing platform is rectangularly shaped.

11. The sport apparatus of claim 1, wherein the bearing shell is fit with a ball-shaped elastic rolling element.

12. The sport apparatus of claim 1, wherein the base plate is disc-shaped.

* * * * *